US010661299B2

(12) United States Patent
Yan et al.

(10) Patent No.: US 10,661,299 B2
(45) Date of Patent: May 26, 2020

(54) METHOD AND DEVICE FOR MONITORING PRODUCTION OF FLUID FILM

(71) Applicants: Tak Kin Andrew Yan, Hong Kong (CN); Tak Chung Yan, Hong Kong (CN)

(72) Inventors: Tak Kin Andrew Yan, Hong Kong (CN); Tak Chung Yan, Hong Kong (CN)

( * ) Notice: Subject to any disclaimer, the term of this patent is extended or adjusted under 35 U.S.C. 154(b) by 0 days.

(21) Appl. No.: 14/963,198

(22) Filed: Dec. 8, 2015

(65) Prior Publication Data

US 2016/0184862 A1 Jun. 30, 2016

Related U.S. Application Data

(60) Division of application No. 13/481,947, filed on May 28, 2012, now abandoned, which is a continuation-in-part of application No. PCT/CN2010/000765, filed on May 28, 2010.

(51) Int. Cl.

| | |
|---|---|
| ***B05C 19/00*** | (2006.01) |
| ***B41F 31/02*** | (2006.01) |
| ***B41F 33/00*** | (2006.01) |

(52) U.S. Cl.

CPC ..... *B05C 19/00* (2013.01); *B41F 31/022* (2013.01); *B41F 33/0063* (2013.01)

(58) Field of Classification Search

CPC ..... B05B 12/084; B05C 19/00; B41F 31/022; B41F 33/0063

See application file for complete search history.

(56) References Cited

U.S. PATENT DOCUMENTS

| | | | | |
|---|---|---|---|---|
| 2,951,416 A * | 9/1960 | Shinn | B41F 33/0063 101/335 |
| 2,971,461 A * | 2/1961 | Bradford | B41F 33/0063 101/216 |
| 4,182,259 A * | 1/1980 | Garner | B05C 11/02 118/712 |
| 5,967,050 A * | 10/1999 | Seymour | B41F 33/0045 101/365 |

* cited by examiner

*Primary Examiner* — Joseph S Del Sole
*Assistant Examiner* — John Robitaille
(74) *Attorney, Agent, or Firm* — MacMillan, Sobanski & Todd, LLC

(57) ABSTRACT

A method for monitoring production of a fluid film, including: activating a dispenser to deliver appropriate material from a storage duct to a metering system for even distribution of a fluid film; allowing the fluid film to pass a sample retrieving roller; measuring the fluid film on the sample retrieving roller using a data reading device to obtain film thickness data; transmitting the data to an analyzer to examine the data against a predetermined reference value; transmitting a comparison result in real time by the analyzer to a production equipment controlling console; controlling the storage duct to dispense material through the material metering system and adjusting the film thickness; repeating the above steps to make a film thickness within the reference range; and maintaining the thickness at the narrowest tolerance deviation, and continuously delivering the film onto a substrate for production.

11 Claims, 13 Drawing Sheets

METHOD AND DEVICE FOR MONITORING PRODUCTION OF FLUID FILM

CROSS-REFERENCE TO RELATED APPLICATIONS

This application is a divisional of and claims domestic priority benefits to U.S. patent application Ser. No. 13/481,947, filed May 28, 2012, now pending. U.S. patent application Ser. No. 13/481,947, filed May 28, 2012, now pending, is a continuation-in-part of International Patent Application No. PCT/CN2010/000765 with an international filing date of May 28, 2010, designating the United States, now pending. The contents of the aforementioned application, including any intervening amendments thereto, are incorporated herein by reference.

BACKGROUND OF THE INVENTION

Field of the Invention

The invention relates to a method and device for automatically monitoring the production of fluid film.

Description of the Related Art

To determine the accuracy of fluid film thickness is a common issue of many industries, for example, the glue film thickness of the adhesive pasting production, the grinding film thickness of the food processing industry and the color pigment production, and so on. For even grinding and steady dispensing of flour mixture in the food processing industry, if inappropriate amount of flour mixture is dispensed in the oven, under the fixed speed and steady temperature processing condition, pre-mature cooking or overcooking may occur, and it can also cause fire in the extreme situation. For the substrate pasting production, the correct amount of adhesive application is also an important issue. In normal pasting process, the operator can only execute the quality control inspection from the final product and determine whether the quality is satisfied. In any case of quality problems, such a production batch has already failed to meet standard quality and becomes the uncontrollable wastage.

In the printing industry, the evenness of color film thickness is an important issue to determine the production quality. The determination of the accurate and appropriate printing ink value is a hot topic in the printing industry. Nowadays, color adjustment solely relies on the operator's subjective judgment. Traditional color adjustment is based on the worker's skill. The trial method is employed to achieve the color balance condition. Each color station of a printing machine is equipped with many inking control zones, and a machine operator spends a lot of time to adjust the inking values, which can lead to a great delay of color correction and cause imbalance printing results. In daily life, the stamp surface of a traditional rubber stamp needs to pick up ink film from an ink pad, and stamps onto the paper. If the ink pad lacks of ink, for example, the stamp surface has carried thin thickness of ink film, the printing image will become light, and vice versa, the ink pad with excessive ink will have the too dark stamping. For the case of the imbalance of inking level condition between the ink pad surface, the stamping image will be imbalance and results in stamping failure. Hence, trial methodology has to be applied before every time of stamping. First of all, it has to find out whether the ink pad has sufficient ink, and then proceed of stamping until satisfaction before actual stamping production begins. This is a typical problem which needs to be fixed in the printing industry and the trial methodology is commonly used.

In traditional printing technology, color correction process has to collect the printing information from the printed sheet, and an operator has to use a visual or reading device to scan the traditional color bar to monitor and amend the color value. No matter which method is applied, manually or automatically correcting the color zones needs analysis from the finished product. As a result, the color correction respond time is delayed. During the high speed and large volume production process, the delay of color correction responding time can cause a large amount of defect products. Because of the above reason, the industry needs a direct and pro-active color controlling system to replace the indirect density retrieving method from the conventional color bar.

All industries quality control system needs to retrieve production data for amendment. The work flow of data collection is described as follows: the selection of data reading device; the analyzer installation location; the timing of collecting the production data, and so on. These can clearly distinguish the major different between this invention and the conventional data reading method.

By comparing this invention with the conventional method: This invention technology is overrided the traditional method, the major different of monitoring the fluid dispensing value hardware is installed at the up stream of the production work flow, the reading device has already begun to monitor the metering system and analyzing the material dispensing value before the actual product being made; this system will be repeatedly to compare the dispensing value accuracy with the pre-determined reference setting, it will be in a real time bases to conduct the closed loop adjustment if it is out of range condition, it will amend the fluid thickness continuously and maintain the product quality within tolerance, meanwhile it continues to feed onto the substrate for production and the goal is to deliver the product at the best quality perfect result, hence this is a pro-active and creative quality control technology. In order to have the conventional method of the closed loop fluid thickness control to keep within the tolerance, the amendment data must be collected from the quality control media tool which measures the finished product, the data reading device has to be installed at the down stream of the production work flow, the actual installation position must be at the products discharge location for the fluid thickness inspection from the immediate finished products, which is used to verify the applied material whether it is acceptable or needs to be adjusted. Because of the inspection system can only inspect from the finished products, such inspection position will not be possible nor simultaneously to inspect the dispensing value at the up stream location of fluid metering system for controlling the material dispensing value: for the time being, the production line continues to apply the material dispensing value which has been set prior to the inspection, therefore the defect gets worse as the excessive material are still dispensing until the new dispensing value generates from inspection completion, a passive way of quality control technology.

This invention is a pro-active inspection method, which is different with the passive type of operation. The pro-active method is repeatedly control in production, which is a creative up stream technology. It is a totally vise-verse technology by comparing with conventional passive way technology which inspects the finished products at the downstream location.

The fluid application industry does not record any pro-active way inspection technology at the up stream work flow so far, therefore this invention is the innovative way to adopt the pro-active technology background; creatively changes the conventional passive quality inspection mode from the downstream end product data collection to the up stream position to become a new technology which has a pro-active mode of controlling.

Regardless the described passive way or pro-active way, the data collecting condition can be retrieved from flat or rotating surface; both reading conditions will not affect this invention data retrieving work flow and location setting.

SUMMARY OF THE INVENTION

This invention can solve the technical problem such as, how to provide a method and device which can initiatively, proactively, accurately, appropriately pre-determine and monitor the production of the fluid films at the upstream process. In printing process, applying this initiative and proactive monitor method to accurately adjust the color value against the pre-determined color zone inking value, and achieve the ultimate inking value before production will reduce the unnecessary adjustment time and material wastage and maintain the products in the highest quality level.

This invention provides an initiative and pro-active intelligent controlling method for fluid films in the material metering process, based on measuring the fluid film thickness to automatically control the material metering production system.

The invention provides an initiative, pro-active, intelligent monitoring method for fluid films, comprising:

- activating a dispenser to deliver appropriate material from a storage duct to a metering system for even distribution of a fluid film;
- allowing the fluid film to pass a sample retrieving roller;
- measuring the fluid film on the sample retrieving roller using a data reading device to obtain film thickness data;
- transmitting the data to an analyzer to examine the data against a predetermined reference value;
- transmitting a comparison result in real time by the analyzer to a production equipment controlling console;
- controlling the storage duct to dispense material through the material metering system and adjusting the film thickness;
- repeating the above steps to make a film thickness within the reference range; and
- maintaining the thickness at the narrowest tolerance deviation, and continuously delivering onto a substrate for production.

Printing ink is also a kind of fluid type material. Color pigment becomes a printing ink film after passing through the metering system. The thickness of the printing ink film is measurable. Such an ink film is a color measuring media. The retrieved ink film data can analyze the color value after such material being measured.

In a class of this embodiment, the fluid film is a printing ink film.

The method of the invention can be used to maintain an even ink film color value, to cover up the printing plate surface by accurately adjusting the ink zones.

Each ink zone requires sufficient storage of printing ink, from the material storage duct and the metering system to the printing plate surface, to cover up the printing area, and finally transfers onto the substrate surface for production. For different printing area and each ink zone, different amount of inking value is required. A good printing product needs an even and consistence supply of ink and metering system in order to provide an appropriate inking distribution. The ultimate goal is to accurately maintain and continuously amend the inking system operation without using the finished printing product as the inking value correction aim.

This invention provides an initiative and proactive method, comprising pre-examining the fluid type film thickness, determining the even metering volume, continuously monitoring and maintaining the film thickness within tolerance range, then transferring to the application system for production. The result of each finished product shall be the best and uniform quality as well as at the minimum deviation tolerance level, the high accuracy of the finished products prediction at the best quality result.

In a class of this embodiment, the pre-set fluid film reference target adopts a neutral grey balance technology. Pre-determined black "K" neutral black color value functions as the reference blue print for the neutral grey formation inking units which are the composition of the primary and subsequent color group as reference aim. The analyzer uses the pre-determined black "K" value to compute each related production color unit in appropriate matching condition by determining the desire ink film thickness, proceeds with even metering, amends the ink film when necessary to the uniform condition, continuously transfers to the substrate for production.

This invention can adopt the neutral grey balance technology disclosed International Patent Application Nos. PCT/CN2008/001021 and PCT/CN2009/001490. Based on the neutral grey balance theory, the primary color is the commonly used material for the color printing production, e.g. cyan shaded as blue, magenta shaded as red and yellow. Combining the three primary color in different values forms the color picture. In theory, equal portion of the primary color mixed with each other will form a dark black color called "neutral black". The "neutral grey" is the result of the equal portion of pre-determined percentage of halftone. Further combination of a primary color and a secondary color such as a primary color with its opponent color can also form the "neutral grey" which comprises cyan+red, magenta+green, and yellow+blue. To combine more subsequent color groups with the appropriate condition can be also form the "neutral grey".

This invention related to the usages of neutral grey balance theory. The primary and subsequent color have their color balance relationship, which provides the accurate balanced color value information for pre-determining the ink film thickness. Using the initiative, pro-active control of each color ink film thickness, positively monitoring the requirement of each color printing unit ink film thickness shall maintain the neutral grey condition. This invention also involves the usages of many different measuring methods, continuous determination, automatic adjustment of the inking value to even distribution on the printing plate surface, and then transferring to the substrate surface. Such printed area shall receive an even inking value/ink film thickness/ink density for executing production.

This invention is the method of initiative, pro-active pre-determination of ink setting which can rapidly and accurately control the ink film thickness, and then the ink film is transferred to the printing plate for continuous production. The printing result of each printed sheet can achieve the consistency and keep within the tolerance. The advantage of this invention is fast to set up the equipment, greatly reduce the ink and material wastage, less demand of operator's color technical skill, remove the subjective decision of color adjustment, and unrestricting of reproduction. High accurate prediction and control of the product's quality is the ultimate advantage.

This methodology of this invention is an intelligent proactive color determination system, which is combined with the neutral gray balance color theory. During the printing process, the individual production unit inking evenness does not represent the color values in all units and the color imbalance may significantly affect the printing results. Based on the grey balance theory, the primary colors and subsequent colors must be in appropriate proportion to form a neutral gray balanced printing. The pure black (neutral black) color film is used to determine the color value of density/brightness reference for each color composition to form the neutral gray, such a result can ensure the entire printing job achieving balanced color.

The invention adopts the working principle of the neutral gray balance and monitoring system: the ink dispensing system of each color production unit is equipped with the ink film thickness reading device, continuously measures and extracts of data, calculates and adjusts. By using the grey balance theory, the pre-determined value of black color becomes the reference target for the grey balance component colors to form the appropriate ink film thickness for the grey balance printing. This invention device can prepare the desire ink film in advance and then automatically adjust within its color production unit and no needs to retrieve the inking correction information from the printed job; hence the result can greatly reduce the examination time as well as the speed of grey balance correction.

Neutral grey color balance component is based on the combination of color values between the primary and subsequent color density and brightness of color gamut value. This invention is creative, initiative, and proactive in measuring the color film thickness to interpret the pigment density, color gamut, brightness value for the color correction value of each color. It is a practical, effective, simple, direct, fast and accurate measuring method compared with a traditional measuring method.

The invention provides an initiative and proactive intelligent fluid type film monitoring device, comprising a data reading device, a sampling roller, a data conversion system, a comparison system, and a production control system. The data reading device is attached on the drive shaft, and scans film thickness values from the surface of the sampling roller, and then the data will be transmitted through a signal line to a data conversion system, the comparison system sends the correction instructions to the production control system for conducting the correction.

The device is equipped with an intelligent control system. Such a device comprises the data reading device, the comparison system, and the production control system, and the data conversion system. The data reading device for each production unit will obtain data, and sends the data to the comparison system via the data conversion system. After the comparison system analyzes and determines the film thickness correction plan for each production unit, the production control system executes the control process. The steps are repeated for intelligent control.

Referring to FIG. 21, the controlling work flow circuit diagram of determining the grey balance value, measuring, analysis, calculation and execution are summarized as follows: to begin with, the comparison system has been set with the default neutral grey balance value, and then sends the default color film thickness to the reference value circuit. At the same time, the PLC programmable control device attached to the printing units 1, 2, 3, 4, and etc sends commands to the data reading device, to execute the ink film data collection operation. The thickness value is forwarded to the signal receiving system for analysis, and then the ink film thickness comparison unit compares the value against the default setting and determines whether the correction is necessary, if necessary, the amended data will be processed by the amplifier. Finally, the selector will determine the color correction requirement and then return signal to the comparison system. By referencing from the color value and ink film thickness look up table, the correction command will transmit the correction value in real time through the production control system for repeating operation.

While in production, the device allows an operator to input the new reference value based on the actual requirement to the data comparison system for the real time appropriate adjustment and controlling operation.

The data reading device of the device can be installed independently, and work back and forth along the drive shaft to scan the surface of the sampling roller for the film thickness data collection (as shown in FIGS. 4, 5, 6A, 6B).

The data reading device can also be installed with a rotational measuring head for changing the measurement direction (as shown in FIGS. 7A, 7B).

The data reading device can also be installed on the drive shaft with the reflector or similar reflection device which is in 90 degrees angle of measurement between the sampling roller to collect the film thickness information (as shown in FIGS. 8A, 8B).

The data reading device can be installed on a fixed rack with a plurality of reading heads; such heads collect the film thickness data from the sampling roller surface (as shown in FIGS. 9, 10, 11A, 11B).

The measuring device can be equipped with the following elements:

i) a single scanning head, which can be traveled back and forth, or work with a rotational reflection device to travel back and forth over the ink film thickness sampling roller to collect data from each color zone (as shown in FIGS. 4, 5, 6A, 6B, 7A, 7B, 8A, 8B); or ii) a plurality of scanning heads, a series of connected reading heads. The quantity is based on the spacing between the number of ink zones and they will be placed along the sampling roller to collect data from each ink zone (as shown in FIGS. 9, 10, 11A, 11B).

The reading speed of a plurality of scanning heads system is faster than that of the single head.

This invention has a comprehensive evaluation on color values with initiative proactive adjustment features. The data reading device can collect ink zone values from each color production unit, such values will pass through the analyzer to determine the requires ink film for achieving the evenness inking coverage, and then to adjust the suitable inking quantity according to the actual requirement.

The device is equipped with a compensation system to assess production environment changes such as production speed, operation temperature, humidity and etc for making film thickness compensation and controlling the tolerance deviation.

There are two choices of selections:

i) Grey Balance analyzing system: Grey balance analyzing system takes into account the relationship between color unit inking values for achieving the grey balance condition, and compares the value with the "K" Black ink value to achieve grey balance production, then the analyzing system transmits the suitable inking values to each color production unit for increasing or decreasing the ink zones correction for the best grey balance result at minimum deviation.

ii) Non Grey Balance analyzing system: For special color production, the grey balance analyzing system will be switched off, each color printing unit will resume its independent color assessment initiative proactive analyzing function, each color unit does not have the inter color balance relationship, the operator has the choice of using the number of printing unit and determines the inking value to meet the product requirements.

The data reading procedure of the device of the invention is:

1) Grey Balance production: Based on the product requirement, the pre-determined black "K" value will transmit to the color comparison system for continuous analyzing of the color correction values. The ink film thickness data reading device will continuously collect the inking values from each ink zone through the sampling roller, and the data will be directly provided to the grey balance analyzer for determining each color correction scheme, repeatedly to execute the amendment of ink zone values adjustment through the production control system.

2) Non Grey Balance production: Based on the product requirement, specially define each production unit inking value, then transmit the values to the data reading device for continuous analysis of the ink zone values adjustment. The ink film thickness data reading device in each inking unit will continuously collect the ink zone values through the film thickness sampling roller for determining color correction scheme, repeatedly to execute the amendment of ink zone values adjustment through the production control system.

The use of the neutral grey balance analyzing system requires to input the pre-determined grey balance value as the standard reference data, which comprise precise ink film thickness of the primary and subsequent colors and the density or color brightness values. The reference data is converted into the ink film thickness. The data reading device will be continuously monitor and verify with the pre-determined reference data for correction purpose. The excessive or in-sufficient inking value will be immediately delivered to the production control system console for real time amending of each color production unit for accurate ink film thickness adjustment.

The installation of data reading device can be classified into internal and external type. The internal type needs to follow the design of the production machine metering system and to determine whether there is enough space available to do so, needs an appropriate installation fixture, and needs permanent fastening of the reading device onto the metering system. The single unit data reading device can be in the form of back and forth traveling. The reading device can be fixed in position with reflective device traveling back and forth or in rotational operation as well as multi units fixed position data reading devices installed on to the fixture, and collects the data from the sampling roller by direct or in-direct contact method for accurate scanning and retrieving the data.

The external type is the special design of independent mechanical fixture, and the reading device needs to be fastened. The single unit data reading device can be in the form of back and forth traveling. The reading device can be fixed in position with reflective device traveling back and forth or in rotational operation as well as multi units fixed position data reading devices installed on the fixture, and have the installation screws to fasten it onto the metering system, with direct or in-direct contact method to collect data from the sampling roller. In additional, the external unit can also be divided into with and without sampling roller, which depends on the selection method of data collection.

The film thickness data collecting system can be more than one unit to collect the multiple film thickness measurement data from the metering system. The purpose of multiple data collection can provide more film thickness samples to achieve accuracy by mathematical analyzing method.

To increase the scanning capability, more than one type of data reading device can be installed within one sampling system for data reading operation.

The data reading device can employ mechanical type reading, or employ a resistive tensioning reading to detect the surface tension resistance value during the ink film metering, and the value can be used to determine the ink film thickness; besides, it can also be an electromagnetic type, ultrasonic scanning type, or a laser and optical scanner.

The device can select a particular color data reading device to collect the measurement, which uses the individual color printing unit's independent ink film thickness analyzer to continuously collect the ink film thickness value, to perform real time analyze on each ink zone inking condition, then forwards the amended inking value to the ink dispensing system accordingly.

This invention device can be used in combination with mechanical, electronic, and digital production equipments.

The data reading device scanning system can be classified as following: Mechanical reading device, using the mechanical contact to measure the actual ink film thickness; the resistive tensioning reading to detect the surface tension resistance value to determine the film thickness; electromagnetic reading device, using the suitable magnetic wave energy, to absorb, to reflect or to penetrate the ink film on the roller surface; an ultrasonic sensor, comparing the sound wave time traveling difference between the ink film and sensor to determine the changes of film thickness; the laser measuring device, using the laser ray emission and receiving time difference to measure the micro meter distance; the optical reading device such as densitometer, spectral densitometer, imaging device, spectrometer, it can be used to directly analyze the ink film density, contrast, color strength, chromatic result. The above measuring data can determine the grey balance condition by using the reference black (neutral black) color, this is used to initiatively and proactively determine the particular production color printing unit ink film thickness in balancing to each other to form neutral grey, and then proceed printing onto the substrate. Those color without the grey balance relationship will become a special color, that particular production unit can select the pre-determined ink film thickness and disable the neutral grey balance analyzing system, automatically scan, monitor, amend such ink film thickness to fulfill the even coverage on the application roller system to execute printing process.

The data reading device obtains data through the PLC programmable controller to compute and digitize the result, and then transmit in optical, electronic, digital form to the computer to calculate and determine the ink film thickness, this can provide appropriate correction values to the production control system for amending the ink film thickness.

FIG. 20 is the conversion chart for the ink film thickness, density, and color brightness value. The market available color substance has carried different fluid body; the fluid type printing ink film thickness is based on its physical characteristic to represent the ink density, color brightness relationship. The look up table is used to record each color unit ink film thickness, density, and color brightness values.

Based on the above scanning methods, installation means, creating the look up tables, data retrieving, all of these can provide the information for the grey balance analyzer to predict each primary color ink film thickness to achieve the grey balance, and then compare the grey value with the pre-determined "K" reference value. When necessary, increasing, decreasing, or maintaining each color unit's inking value through the optical, electronic, digital transmission method for sending the amendment to the production control console in real time, to initiatively, pro-actively, and continuously execute the color adjustment. Such color value information will be forwarded to each color printing unit's ink zone for pro-actively pre-determining the appropriate ink film for the high quality and accurate grey balance production.

This invention relates to a kind of initiative, proactive, intelligent controlling device for fluid films. The device can install more than one unit of data reading device or more than one unit of sampling device; it can also be installed more than one unit of data reading devices and more than one unit of sampling device within the metering system to collect multiple fluid films thickness data along the same fluid dispensing zone for determination of the correction value whenever necessary to improve the accuracy of fluid film thickness evenness production.

This invention provides the device for the initiative proactive intelligent control on the fluid type films, which is equipped with an intelligent controlling system, and the device comprises the data reading device, the comparison system, the production control system, and the data conversion system. The data reading device for each production unit's will obtain data, and deliver the data through the data conversion system to the comparison system to analyze and determine the film thickness correction plan for each production unit to execute the amendment through the production control system and execute the control process in closed loop operation.

The fluid film correction system and device can be a direct type, which comprises a sampling roller, doctor blade, container, data reading device, PLC programmable control device. The data reading device is used to collect the excess fluid film information and then transmits the command in real time to the PLC programmable control device to control the gap spacing for controlling the allowable fluid to pass through for forming the film thickness.

The fluid films correction system and device can be an indirect type, which comprises a sampling roller, roller, doctor blade, container, data reading device, PLC programmable control device. The data reading device is used to collect the excess fluid films information then transmits the command in real time bases to the PLC programmable control device to control the gap spacing for controlling the allowable fluid to pass through for forming the film thickness.

DETAILED DESCRIPTION OF THE EMBODIMENTS

The following embodiments of this invention with the content for further elaboration:

Example 1

Figure 1:
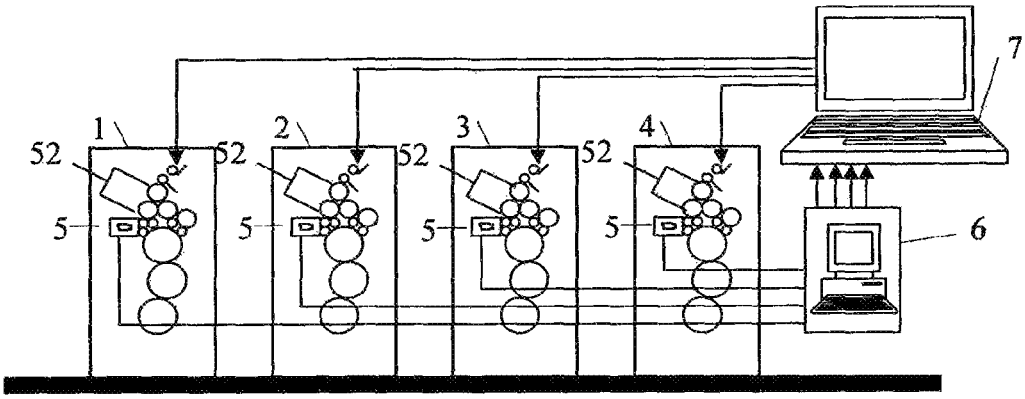
FIG. 1: a schematic diagram of an initiative proactive fluid type films controlling method and device.

Initiative Proactive Intelligent Controlling Method and Application Device for Fluid Type Films See FIG. 1, an initiative proactive intelligent controlling method for fluid type films device comprises a production control system console 7, production units 1, 2, 3, and 4, metering unit 52, a data reading device 5, and a referencing quality analyzing system 6.

To implement this invention which is a kind of initiative proactive intelligent controlling method for fluid type films device comprising: entering the predetermined metering material reference value to the analyzing device 6 as the monitoring reference usages. The analyzing device determines the metering film thickness from the look up table (table 20) which is the relationship between the film thickness and material requirement value. By giving command to the dispensing system for delivering the appropriate amount of material to the metering unit 52 and execute the even film metering via the sampling roller 9; operate the data reading device 5 to measure the film thickness from the sampling roller 9, obtain the data and transmits to the analyzing system 6 against the film thickness reference for comparison. If the comparison result is not acceptable, the analyzing system 6 will deliver in real time the film thickness correction value to the production control system 7 for controlling the dispensing system through the metering unit to correct the production film thickness. The above description is a repeatedly operation process, it can rapidly provide the film thickness to achieve the reference range, and maintain within the narrowest tolerance deviation, continuously deliver onto the substrate for production. It can maintain the highest quality result and achieve the closest tolerance as well as minimum wastage. For each production unit, the even film thickness does not have any color balance relationship, the operator can freely determine the film thickness setting to achieve the product requirement.

Any similarity of the following examples' methodologies and devices to this example will not be repeated.

Example 2

Figure 2:
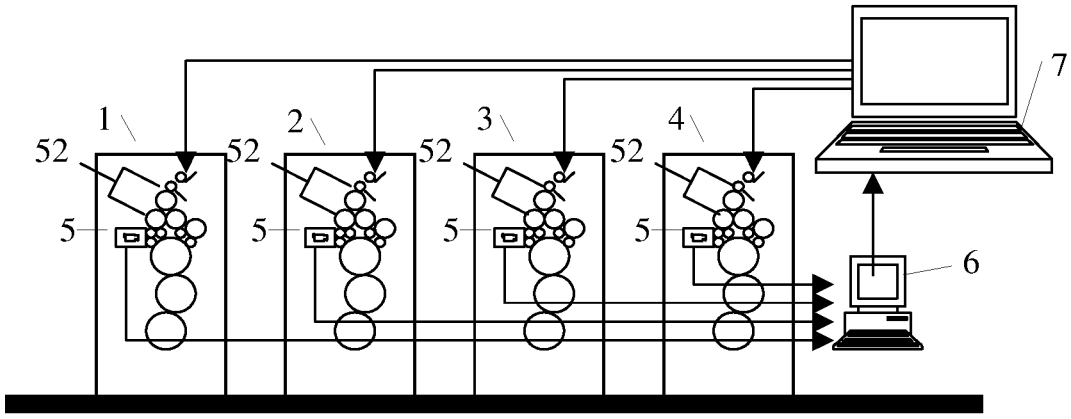
FIG. 2: a schematic diagram of an initiative proactive fluid type films controlling method and device with adoption of the neutral gray balance monitoring system.

Initiative Proactive Intelligent Controlling Method and Application Device for Fluid Type Films with the Adoption of the Neutral Grey Balance Production Technology See FIG. 2, a device comprises a production control system 7, production units 1, 2, 3, and 4, metering unit 52, data reading device 5, and the neutral grey balance comparison system 6. Based on the pre-determined printing color sequencing order, freely place the black, cyan, magenta, and yellow ink onto the printing units 1, 2, 3, and 4. Enter the pre-determined black ink value to the neutral grey balance analyzing device 6 as the neutral grey balance requirement referencing usages. The analyzing device will determine the metering film thickness from the look up table (table 20) which is the film thickness and material dosage value. The black, cyan, magenta, and yellow inking unit data reading device 5 will measure the film thickness from the sampling roller 9, by using the initiative and proactive method to provide the neutral grey balance information to the analyzing device 6 to compare with the pre-determined black inking value. If it is not acceptable, it calculates the grey balance value for the neutral grey balance component colors to determine the correction ink film thickness value, and transmit to the production control system 7, by giving command to each printing unit inking dispensing system to deliver the appropriate amount of printing ink to the metering unit 52 and execute the ink film metering. The above process is a repeated operation, it can be highly accurate to provide the film thickness for achieving the reference range and maintaining within the tolerance, before delivering to the production line for production, as it is an initiative proactive mode, automatically makes correction in real time bases, continuously maintain the highest quality result and achieves at the closest tolerance as well as minimum wastage.

Example 3

Figure 3:
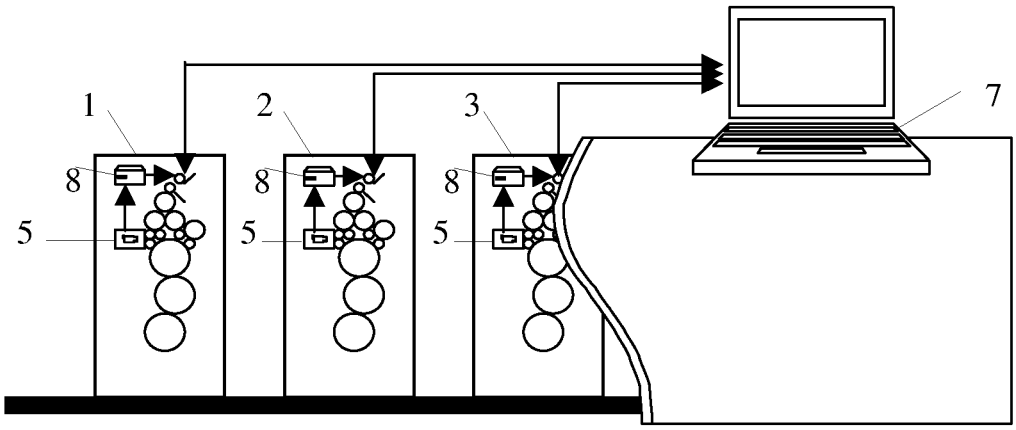
FIG. 3: a schematic diagram of an initiative proactive fluid type films controlling method and device, each production color unit has its own individual inking control and continuously maintain the color correction continuously and each production color unit does not have any grey color balance relationship.

Initiative Proactive Intelligent Independent Production Controlling Modular for Controlling the Fluid Type Film Thickness See FIG. 3, for example in each printing unit, the special color ink can be chosen in printing unit 1 for production. The data reading device 5 will initiatively and proactively measure the color data from each ink zone. The unevenness ink zone result will be sent directly to such unit's ink zone controller 8 in real-time for repeated adjustment, without using the production control system 7 for correction. The operator can also use the production control system 7 as the optional choice for changing the ink value(s). Any similarity to this embodiment will not be repeated.

Example 4

Figure 4:
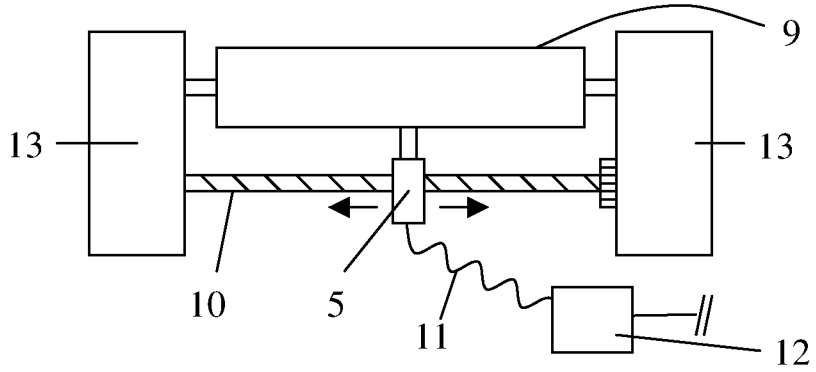
FIG. 4: a schematic diagram of an internal type single unit data reading device, back and forth measuring.

Built-in Monitoring Type of an Initiative Proactive Intelligent Controlling Modular for Controlling the Fluid Type Film Thickness See FIG. 4, provided is a housing of the production equipment 13. A single data reading device is attached to the drive shaft 10, the data reading device 5 travels back and forth as the arrow direction along the drive shaft 10, carries the scanning head back and forth, accurately reads the ink film thickness from the surface of the ink film thickness sampling roller 9. Using optical, electronic, digital transmission connection 11 delivers the data to the PLC programmable control device 12 for digitize the reading; it is an initiative and proactive production system for continuous monitoring and correction usages.

Example 5

Figure 5:
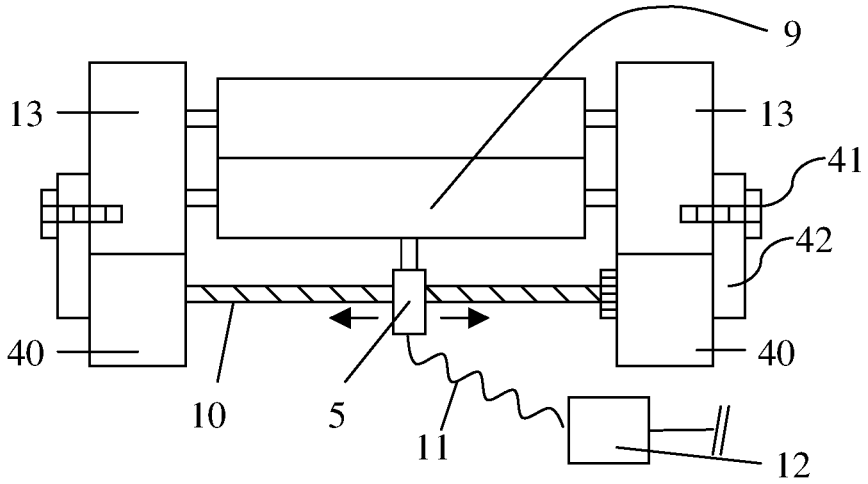
FIG. 5: a schematic diagram of an external type single unit data reading device, back and forth measuring without sampling roller attachment.

Independent Single Piece External Type Monitoring Device of an Initiative Proactive Intelligent Controlling Modular for Controlling the Fluid Type Film Thickness See FIG. 5, the production machine is not equipped with a sampling roller. This invention system needs to design an independent mechanical anchorage device, equipped with a frame 40, by using fastening screws 41 to secure the connection bars 42 against the production machine's metering system housing 13. Drive shaft 10 is equipped with a single data reading device 5 with operating back and forth as the arrow indication direction and working along the drive shaft 10, to accurately scan the ink film thickness from the surface of the sampling roller 9 for the thickness value. Any similarity to this example will not be repeated.

Example 6

Figure 6A:
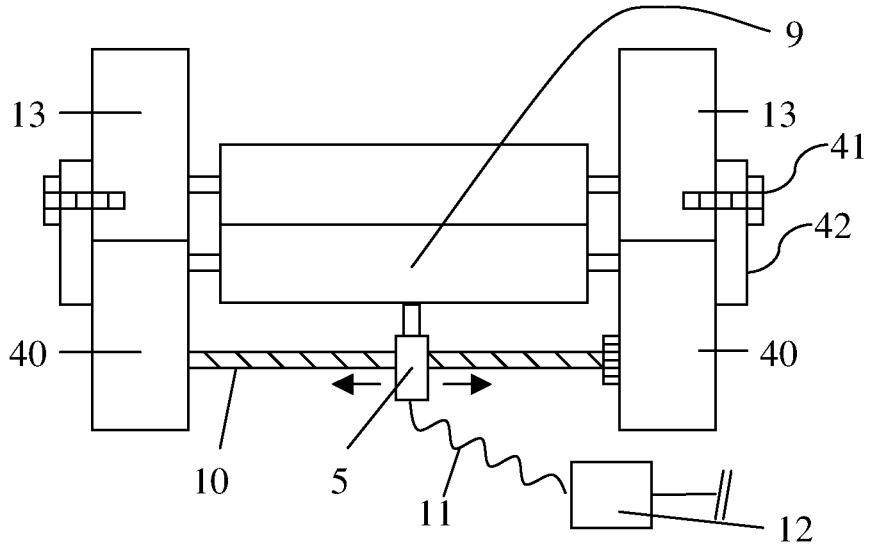
FIG. 6A: a schematic diagram of an external type single unit data reading device, back and forth measuring with sampling roller attachment.
Figure 6B:
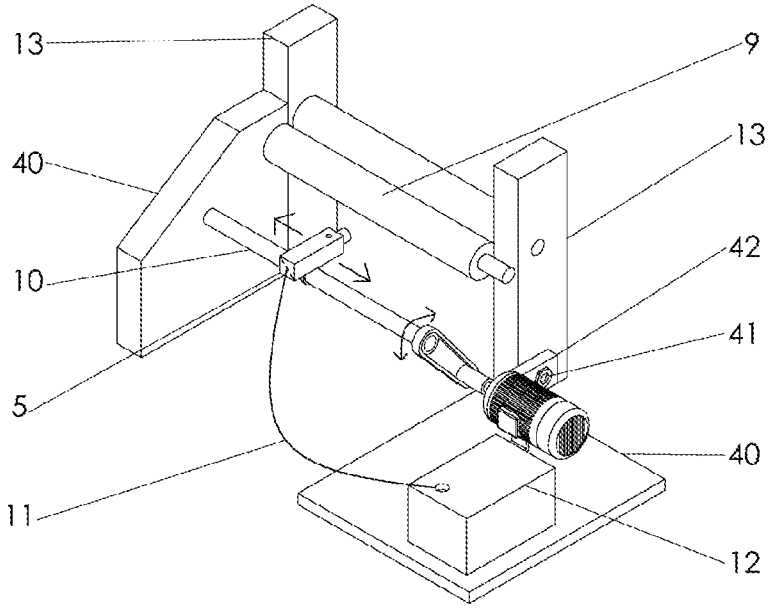
FIG. 6B: a three-dimensional diagram of an external type single unit data reading device, back and forth measuring with sampling roller attachment.

Independent Single Piece External Type Monitoring Device of an Initiative Proactive Intelligent Controlling Modular for Controlling the Fluid Type Film Thickness See FIGS. 6A, 6B, the system is equipped with a sampling roller. The system basic functionality is similar to that of FIG. 5, and the only different is that the ink film thickness sampling roller 9 is installed at the frame 40 as part of the single piece monitoring modular. Any similarity to the embodiment 4 will not be repeated.

Example 7

Figure 7A:
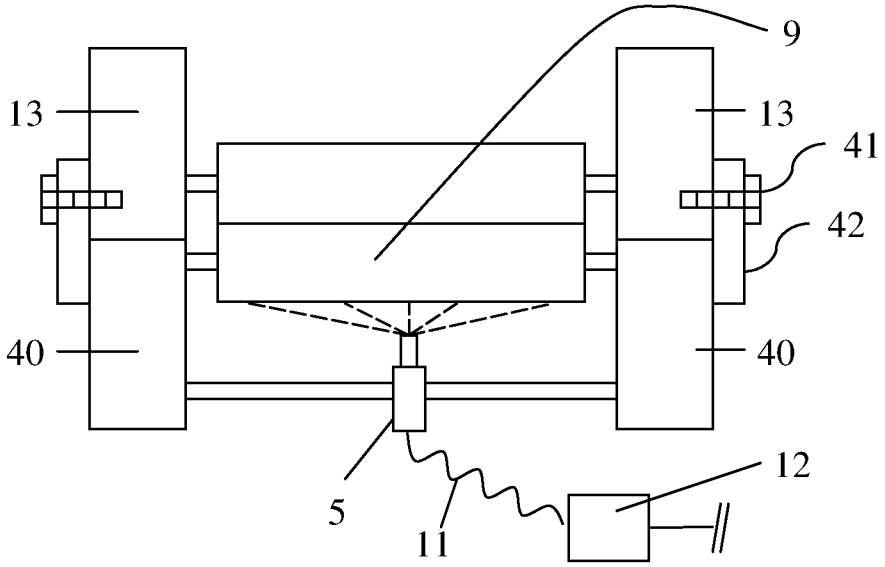
FIG. 7A: a schematic diagram of a fixed external type single unit data reading device with adoption of the rotational mirror or similar device, by diffract the measuring angle direction back and forth the sampling roller.
Figure 7B:
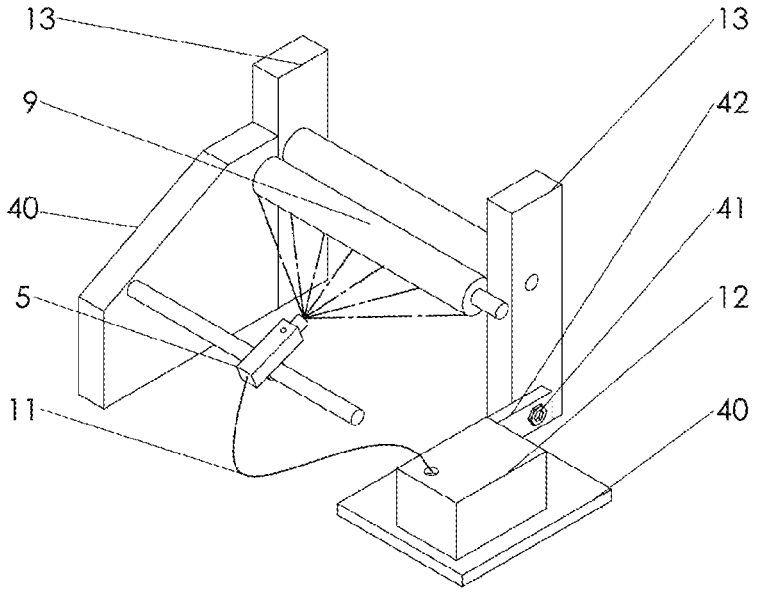
FIG. 7B: a three-dimensional diagram of external type single unit data reading device.

Independent Single Piece External Type Monitoring Device of an Initiative Proactive Intelligent Controlling Modular for Controlling the Fluid Type Film Thickness See FIGS. 7A, 7B, the system is equipped with a sampling roller. The system needs to design an independent anchorage device, equipped with an installation frame 40, by using fastening screws 41 to secure the connection bars 42 against the production machine metering system housing 13. A single data reading device 5 is fixed onto the bracket. The reading device can collect the ink film thickness from the rotational reflector or similar reflection device, by changing the angle of measurement in between the sampling roller 9 surface, to accurately scan the ink film thickness for reading the value. Any similarity to the example 4 will not be repeated.

Example 8

Figure 8A:
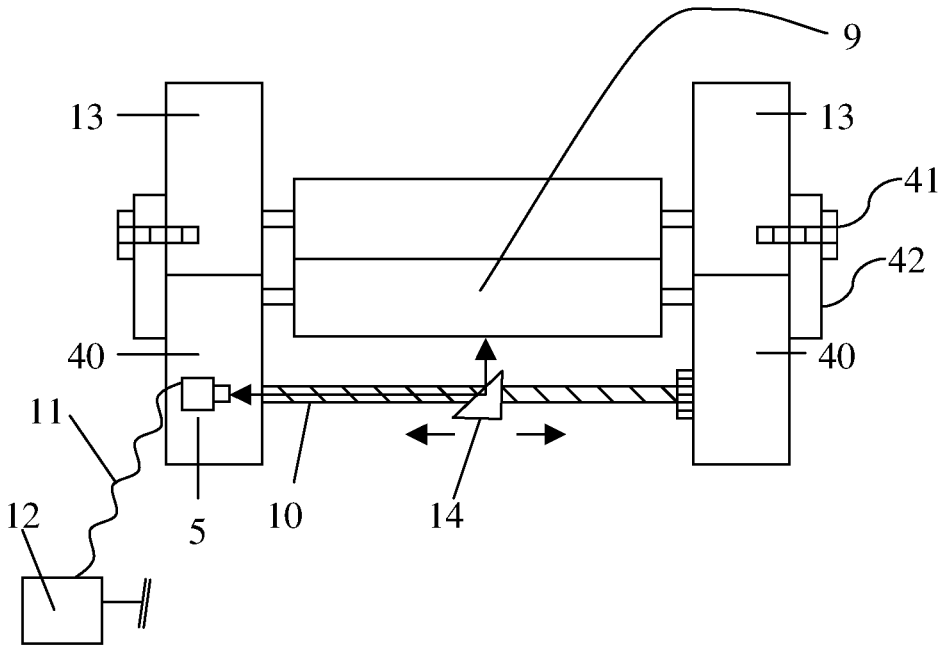
FIG. 8A: a schematic diagram of a fixed external type single unit data reading device with adoption of the mirror or similar device, by diffract 90 degree the measuring angle back and forth the sampling roller, and this system has attached with the sampling roller.
Figure 8B:
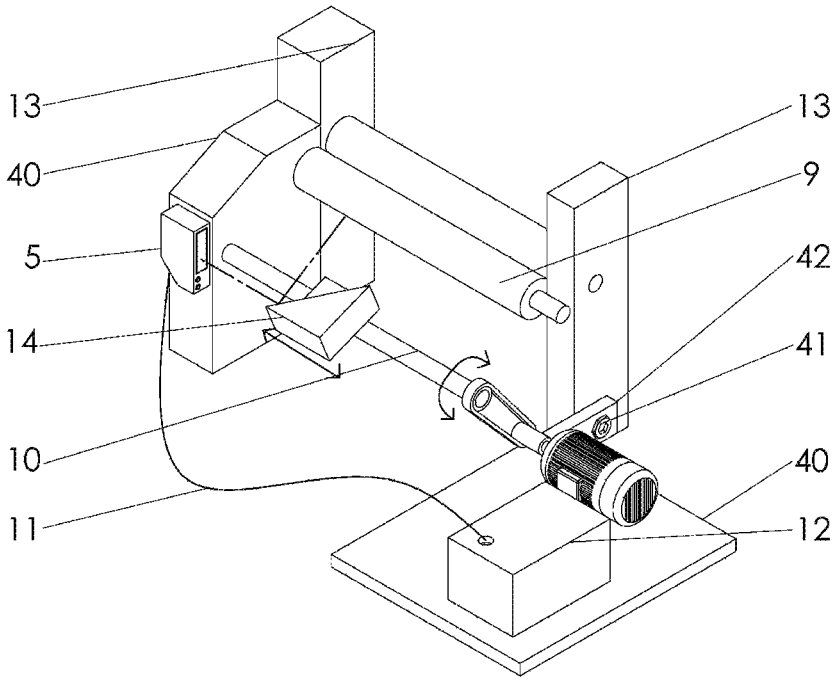
FIG. 8B: a three-dimensional diagram of an external type single unit data reading device.

Independent Single Piece External Type Monitoring Device of an Initiative Proactive Intelligent Controlling Modular for Controlling the Fluid Type Film Thickness See FIGS. 8A, 8B, the system is equipped with a sampling roller. The system needs to design an independent mechanical anchorage device, equipped with an installation frame 40, by using fastening screws 41 to secure the connection bars 42 against the production machine metering system housing 13. A single data reading device 5 is fixed inside the frame 40, the reflector or similar reflective device is attached to the drive shaft 10, back and forth traveling as arrow indicated direction, the reflector or similar reflective device has changed the measurement direction by 90 degree angles between the sampling roller 9 surface. Any similarity to the example 4 will not be repeated.

Example 9

Figure 9:
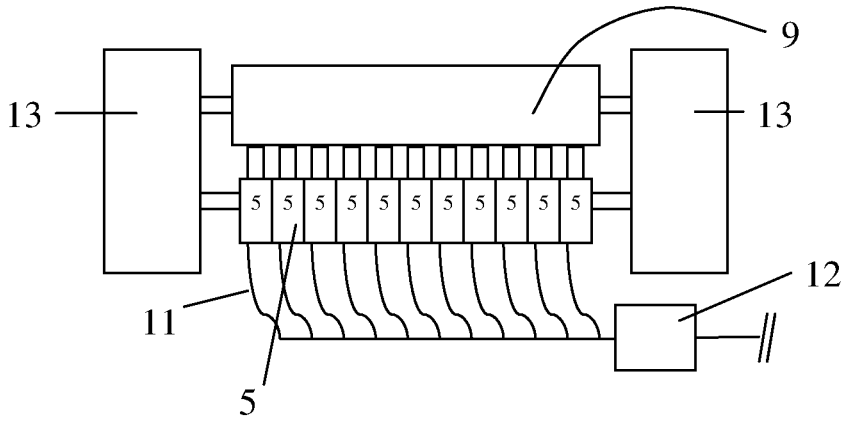
FIG. 9: a schematic diagram of a fixed internal type multi unit data reading device measuring.

Built-in Type Multi Units Monitoring Device of an Initiative Proactive Intelligent Controlling Modular for Controlling the Fluid Type Film Thickness See FIG. 9, the production equipment housing 13 with permanent frame equipped with multi data reading devices 5, accurately read the film thickness values from the surface of the film thickness sampling roller 9. Any similarity to the example 4 will not be repeated.

Example 10

Figure 10:
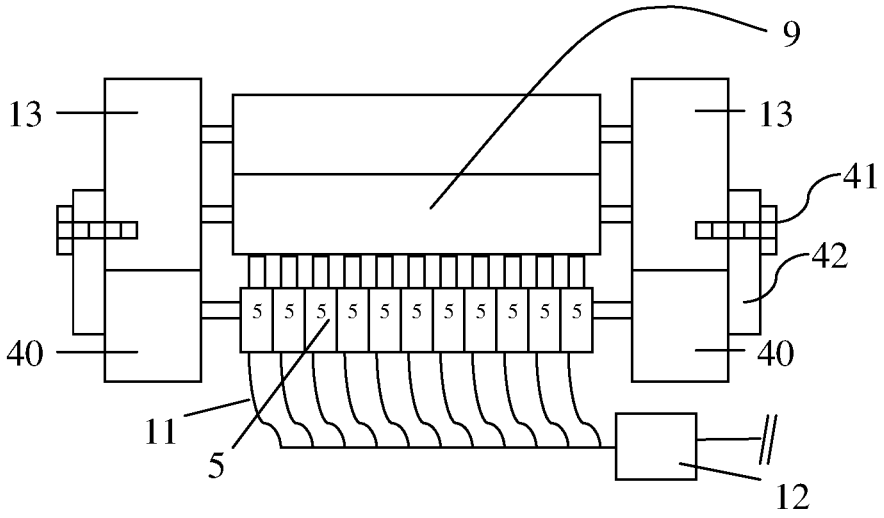
FIG. 10: a schematic diagram of an external type multi unit data reading device without the sampling roller attachment.

External Type Independent Multi Monitoring Device of an Initiative Proactive Intelligent Controlling Modular for Controlling the Fluid Type Film Thickness See FIG. 10, the system is equipped with a sampling roller. The system needs to design an independent mechanical anchorage device, equipped with an installation frame 40, by using fastening screws 41 to secure the connection bars 42 against the production machine metering system housing 13. The multi unit data reading device 5 is fixed onto the permanent structure to accurately scan the ink film thickness values from the surface of the sampling roller 9. Any similarity to the example 4 will not be repeated.

Example 11

Figure 11A:
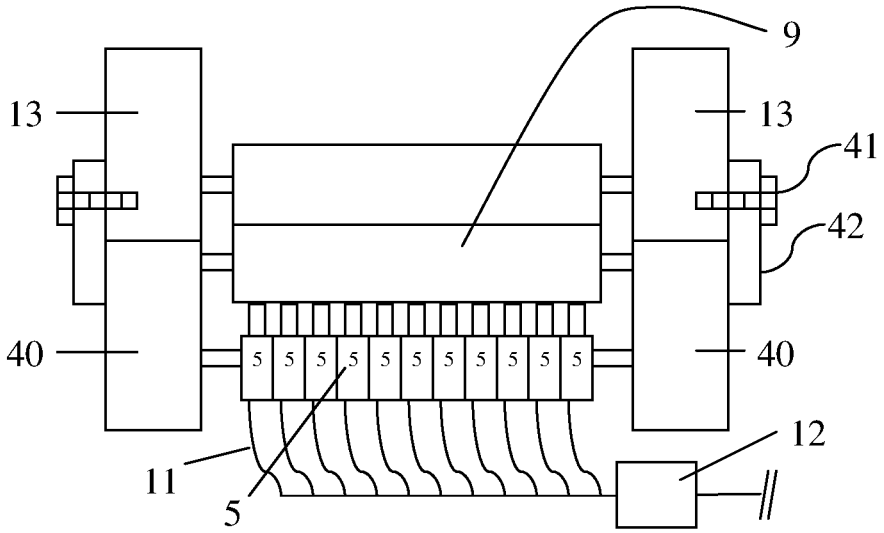
FIG. 11A: a schematic diagram of an external type multi unit data reading device with the sampling roller attachment.
Figure 11B:
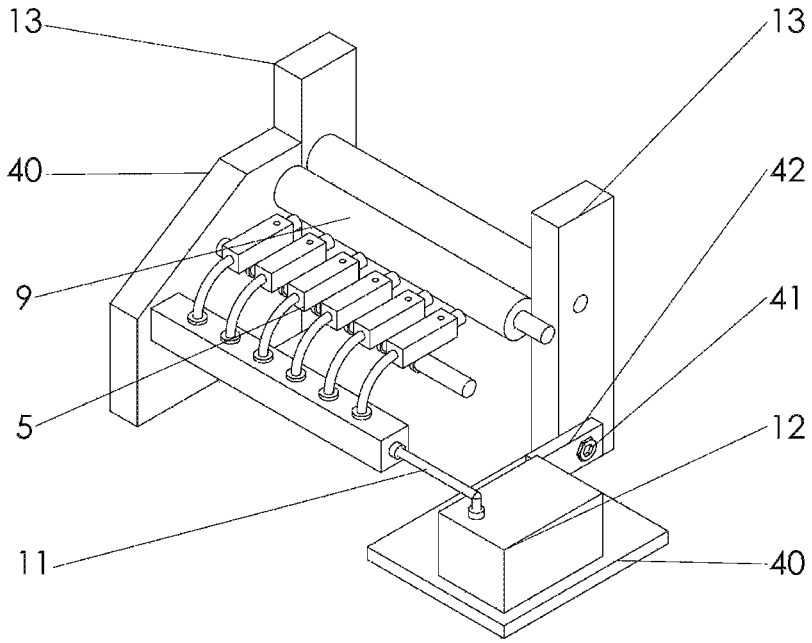
FIG. 11B: a three-dimensional diagram of external type multi unit data reading device with the sampling roller attachment.

Independent Multi Heads External Type Monitoring Device of an Initiative Proactive Intelligent Controlling Modular for Controlling the Fluid Type Film Thickness See FIG. 11A, 11B, the system is equipped with a sampling roller. The system basic design is similar to that of FIG. 9, and the only different is that an ink film thickness sampling roller 9 is installed onto an independent anchorage device 40. Any similarity to the example 4 will not be repeated.

Example 12

Figure 12:
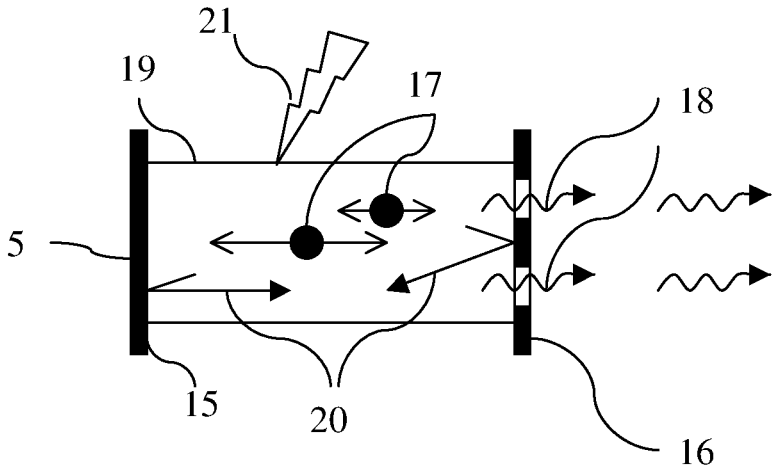
FIG. 12: Laser theory

Laser Type Monitoring Device of an Initiative Proactive Intelligent Controlling Modular for Controlling the Fluid Type Film Thickness See FIG. 12, provided is a laser construction. The system comprises active material 17, which is placed between two reflective type mirrors 15, 16. A resonator 19 is formed by two reflective mirrors and the laser reflective material, by using this to provide the light beam. The atom of the laser active material has been activated by the external energy 21, excited to the higher energy lever condition. The light beam bounces back and forth 20 between two mirrors and then forms an accurate fixed speed of light beam. To release the light beam from the resonator, one of the mirrors 16 can only rebound half of the light beam; this can allow the other half of the laser light beam 18 to freely go through the mirror.

Figure 13:
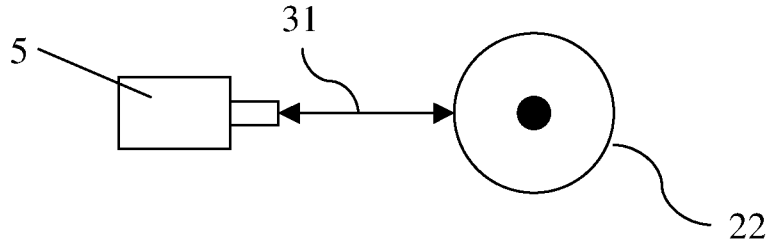
FIG. 13: a schematic diagram of a laser distance measurement of the bare sampling roller without carrying the color film.

See FIG. 13, the data reading device 5 has been equipped with the laser resonator device, laser beam resonator, and light beam receiver to measure the light beam emission and receiving time, and calculate and record the non ink film bare roller surface 22 and the distance 31 between the data reading device. The mathematical formula is as below: displacement=speed of light×the total light traveling time between emission and receiving/2 times (Back and forth journey).

Figure 14:
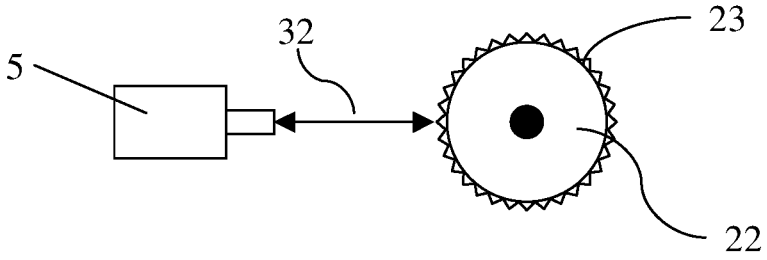
FIG. 14: a schematic diagram of a laser distance measurement of the sampling roller carrying with the color film.

See FIG. 14, the data reading device 5 has been equipped with the laser resonator device to measure the time between the light emission and receiver, and calculate and record the ink film thickness surface 23 and the distance 32 between the data reading device. The displacement result is used to calculate the ink film thickness. The ink film thickness mathematical formula as: the ink film thickness=the bare sampling roller without the ink film displacement 31−the sampling roller adhering with ink film displacement 32.

Example 13

Figure 15:
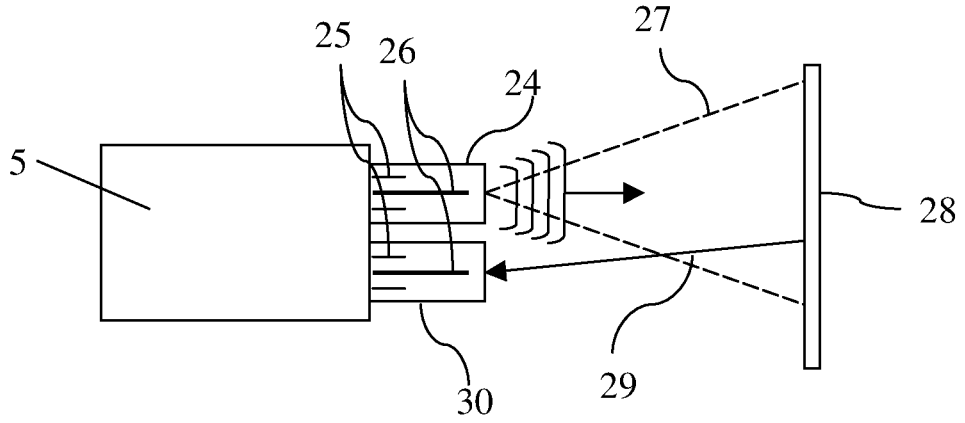
FIG. 15: Ultrasonic theory

Ultrasonic Scanning Type Monitoring Device of an Initiative Proactive Intelligent Controlling Modular for Controlling the Fluid Type Film Thickness See FIG. 15, provided is an ultrasonic emitter 24 which is an electro-gas type ultrasonic generator 27. Piezoelectric emitter comprises two pieces of transmitter chip 25 and a resonance plate 26, and the ultrasonic resonance is generated by applying an external pulse signal onto the transmitter chip and creates vibration. Conversely, the ultrasonic receiver 30 comprises two piezoelectric chips 25, the resonance plate 26 receives the external ultrasound 29, and the ultrasonic wave energy will vibrate the resonance plates, which can convert this mechanical motion to electrode signal for time computing usages.

Figure 16:
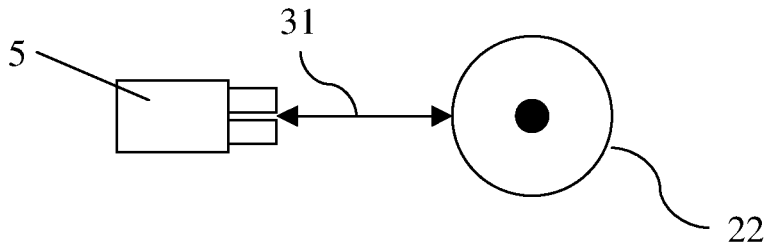
FIG. 16: a schematic diagram of an ultrasonic distance measurement of the bare sampling roller without carrying the color film.

See FIG. 16, the data reading device 5 is equipped with the ultrasonic emitter to measure the time between the sound wave emission and receiving, and calculate and record the bare roller surface 22 without ink film and the distance 31 between the data reading device. The ink film thickness mathematical formula as: displacement=340 (the speed of sound)×the total sound wave traveling time between emission and receiving/2 times (Back and forth journey)

Figure 17:
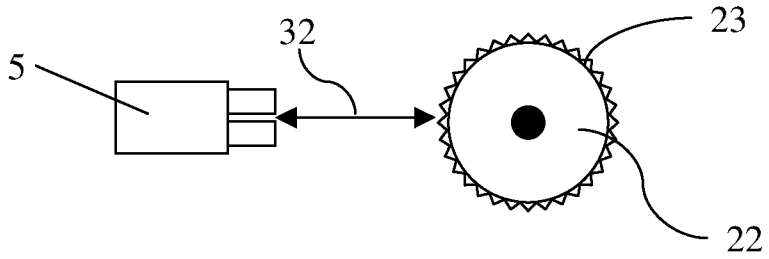
FIG. 17: a schematic diagram of an ultrasonic distance measurement of the sampling roller carrying with the color film.

See FIG. 17, the data reading device 5 is equipped with the ultrasonic emitter, to measure the time between the sound emission and receiver, and calculate and record the ink film thickness surface 23 and the distance 32 between the data reading device. The displacement result is used to compute the ink film thickness. The ink film thickness mathematical formula as: the ink film thickness=the bare sampling roller without ink film displacement 31−the sampling roller adhering with ink film displacement 32.

Example 14

Figure 18:
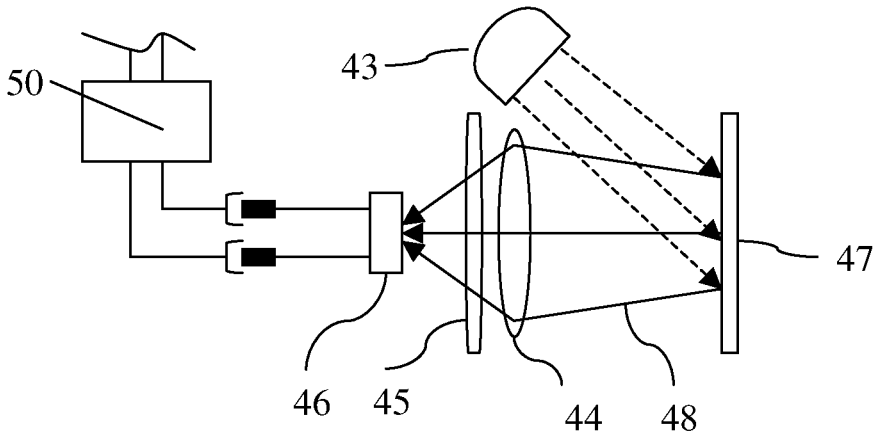
FIG. 18: a schematic diagram of an optical color density and color gamut value reflection measurement.

Optical Type Measuring Device of an Initiative Proactive Intelligent Controlling Modular for Controlling the Fluid Type Film Thickness See FIG. 18, provided is an optical color density and color gamut brightness reflective measuring. The measuring system comprises a standard illumination lighting 43, optical lenses construction component 44, filter 45, spectrometer 46, and optical computing device 50. The reading method is to measure the light reflective data 48 from the reflective material 47. By using the appropriate light source D50, D60 to shine over the measuring subject, the reflective measurement such as paper 47. Such light source penetrates through the examination material to the substrate layer, and then bounces back through the examination material with carrying certain density (the rate of filtering) to reduce the intensity for computing the color density or color brightness or individual color value digitally. The measuring material under illumination by lighting system, the amount of light of reflection, through the optical lenses component and filter, are directly transmitted to the spectrometer or digital imaging device (CCD, CMOS) for measurement. Use the optical computer to accurately analyze the color density or color gamut brightness values.

Figure 19:
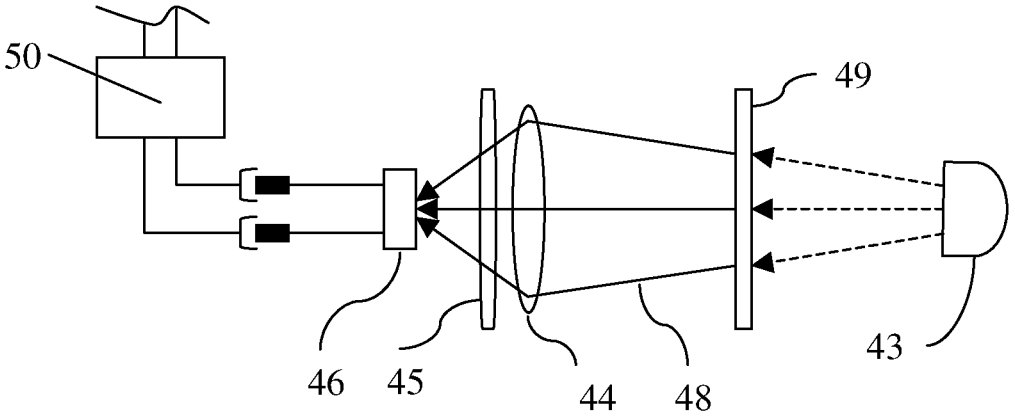
FIG. 19: a schematic diagram of an optical color density and color gamut value transmission measurement.
Figure 20:
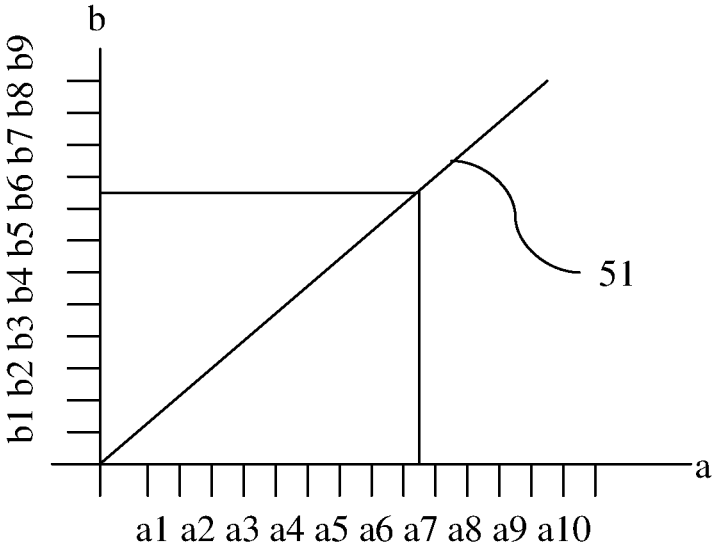
FIG. 20: Look up table for Ink film thickness, color density, and color gamut value.
Figure 21:
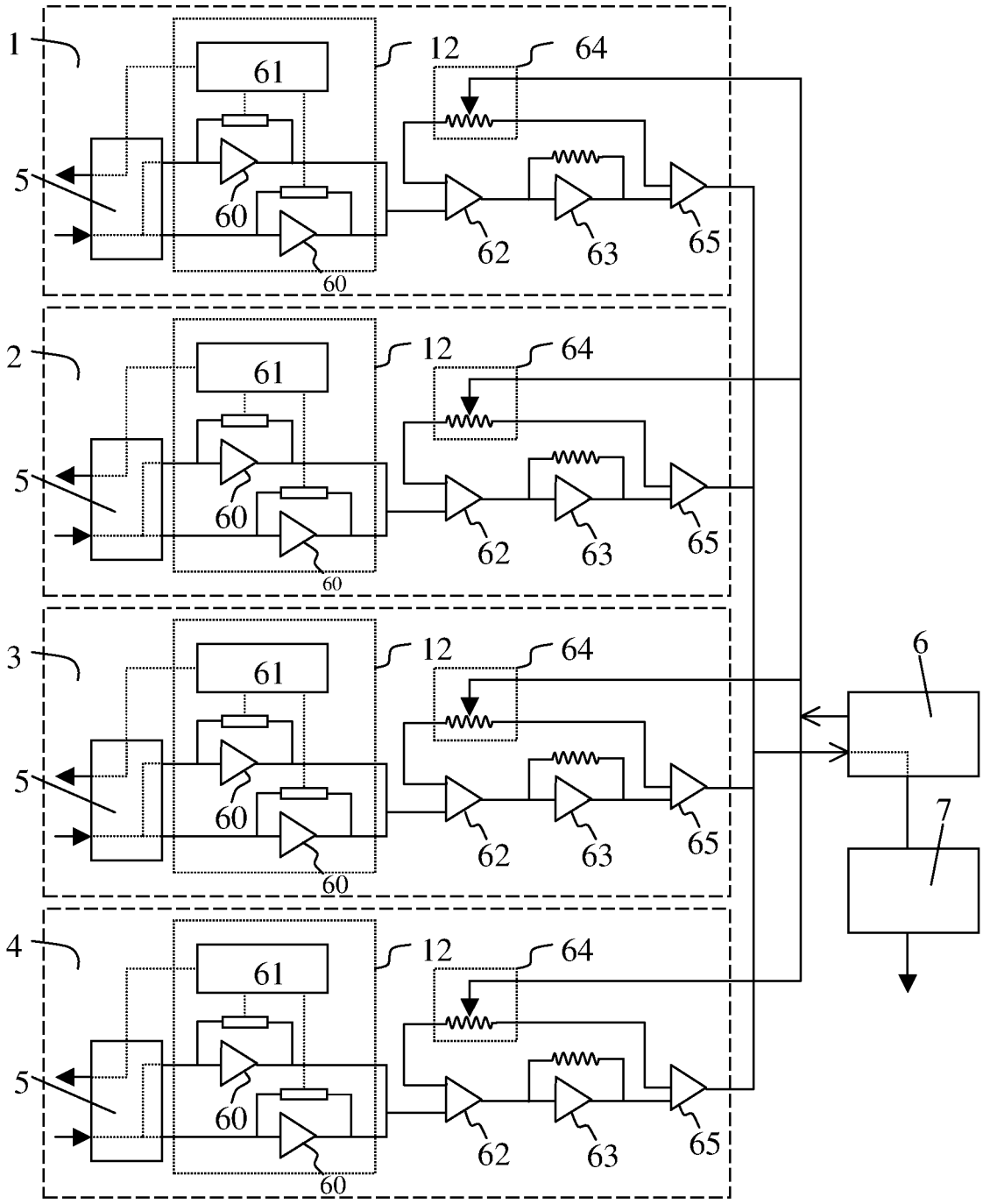
FIG. 21: Grey balance color value determination, measurement, analyzing, calculation, and correction execution control circuit diagram.

See FIG. 19, provided is an optical color density and color gamut brightness penetration measuring. The measuring system comprises a standard illumination lighting 43, optical lenses construction component 44, filter 45, spectrometer 46, and optical computing device 50. The reading method is to measure the light penetration data 48 through the sampling material 49. Use the appropriate light source D50, D60 to shine onto the measuring subject, and get the penetrative measuring from the transparent film media 49 density. Such light source will depend on the density of the measuring material (rate of transparent) to reduce the intensity for computing the color density or color gamut brightness or individual color value digitally. The measuring material under illumination by lighting system, the amount of light of penetration, through the optical lenses component and filter, are directly transmitted to the spectrometer or digital imaging device (CCD, CMOS) for measurement. Use the optical computer to accurately analyze the color density or color gamut brightness values.

Implementation of the method for the fluid type films is equipped with the direct and indirect controlling systems and devices.

Set a fixed distance 33 in mechanical way that the fluid thickness can pass through. The excessive fluid film 37 will be collected by the adjustable mechanical spacing roller 34 and doctor blade 35. This controlling system is equipped with data reading device 5 for monitoring whether there is any excessive fluid film and real time re-adjust the dispensing value and re-set the distance 33 for controlling the film thickness. The doctor blade installation can be a direct and in-direct method.

Example 15

Figure 22:
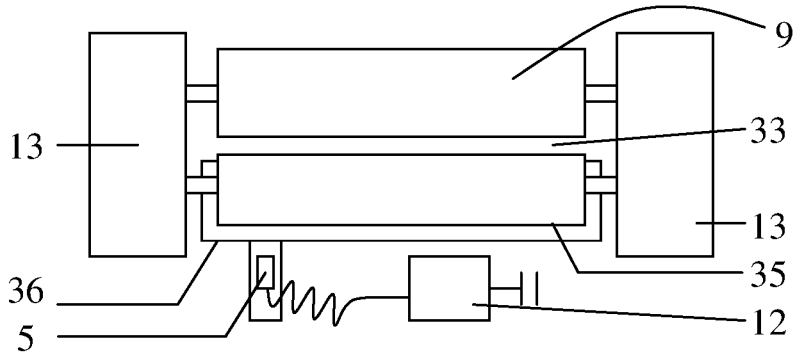
FIGS. 22, 23: Fluid type film direct correction system and device schematic diagram.
Figure 23:
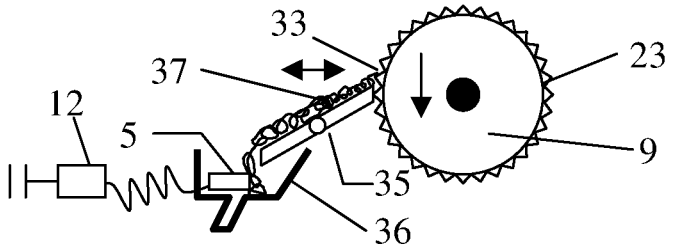

FIG. 22 and FIG. 23 show a direct-type system and device. The sampling roller 9 is equipped with a doctor blade 35 with pre-determined distance for collecting the excessive fluid type film. Such a distance 33 is the spacing which can make the fluid films pass through. The excessive fluid film 37 will be removed by the doctor blade and store at the container 36 for re-cycling back to the dispensing duct. The container is equipped with a data reading device 5, which is used to monitor whether there is any excessive fluid film collected. If the device 5 has detected signal, then the amendment command will be sent in real time to the PLC controlling unit 12 for digitize the signal. The material duct changes the dispensing value and the spacing 33 by the doctor blade 35 for direct control of the film thickness. This system is an initiative and proactive consistent monitor to amend the fluid film thickness requirement.

Example 16

Figure 24:
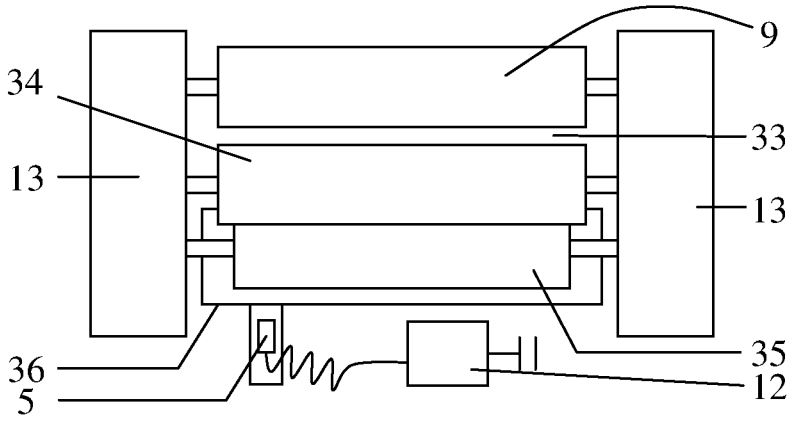
FIGS. 24, 25: Fluid type film in-direct correction system and device schematic diagram.
Figure 25:
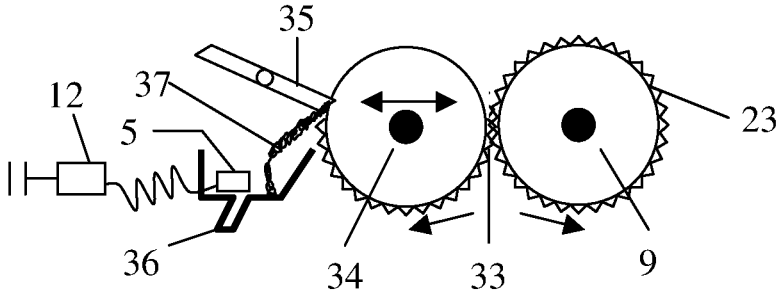

FIG. 24 and FIG. 25 show an indirect-type system and device. The sampling roller 9 is equipped with a roller 34 with pre-determined spacing to collect the excessive fluid film. The roller surface is equipped with a tight fit doctor blade 35. Such a distance 33 is the spacing for fluid films to pass through. The excessive fluid films 37 will be removed by the pre-determined spacing roller; the tightly contacted doctor blade will continuously collect the excessive fluid from the pre-determined spacing roller and store at the container 36 for re-cycling back to the dispensing duct. The container is equipped with a data reading device 5, which is used to monitor whether there is excessive fluid films collected. If the device 5 has detected signal, then the amendment command will be sent in real time to the PLC controlling unit 12 for digitizing the signal. The material duct amends the dispensing value and re-determines the spacing 33 by the pre-determined spacing roller 34 for direct control of the film thickness. This system is an initiative and proactive consistence monitor to amend the fluid film thickness requirement.

Example 17

Figure 26:
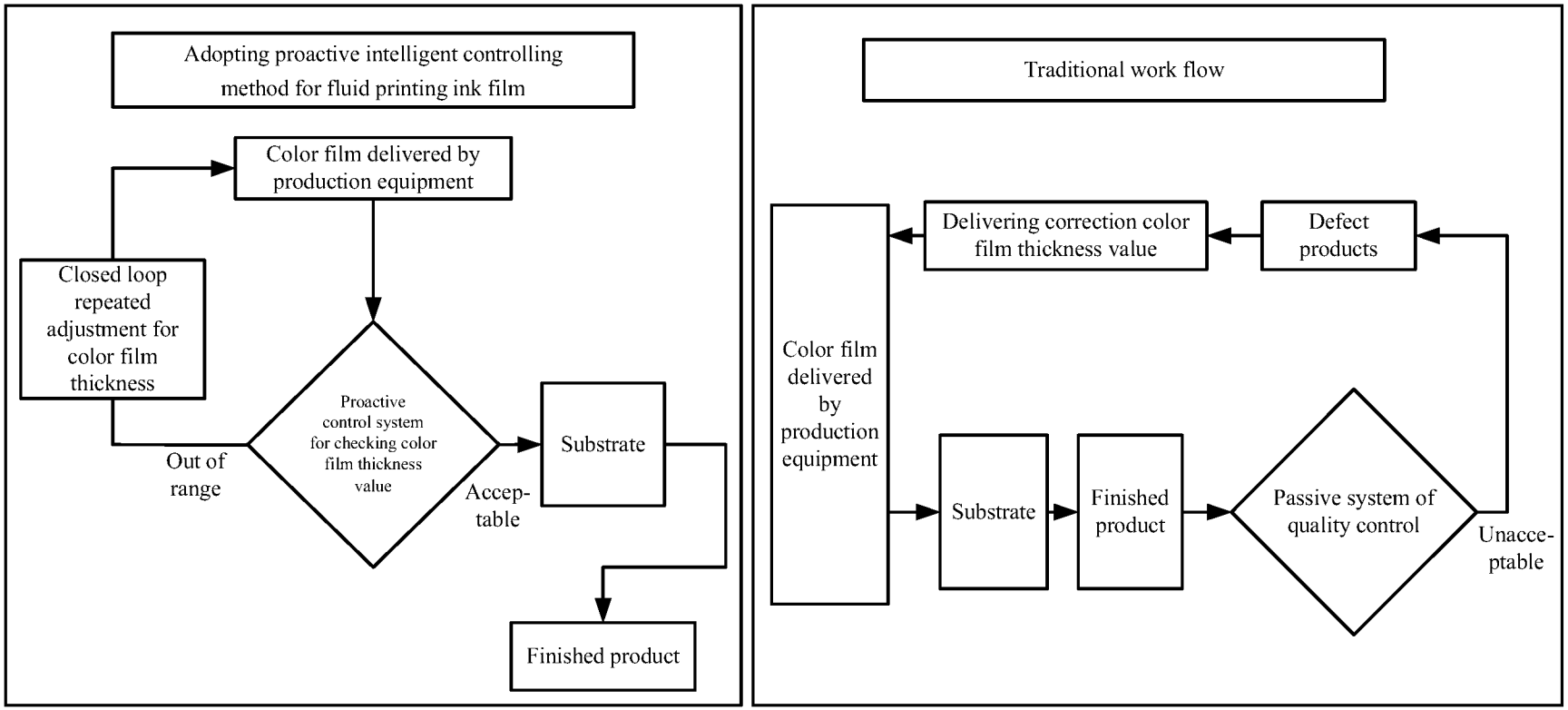
FIG. 26: The proactive intelligent controlling method for fluid printing ink film thickness value vs the traditional passive system color film thickness controlling method.

FIG. 26: show the different work flow for the proactive intelligent controlling method for fluid type color printing ink film thickness value vs the traditional passive color film thickness controlling method.

The proactive intelligent controlling method for fluid printing ink film thickness value work flow has begun with:

a) color film delivered by production equipment to begin the production;

b) by using the proactive control system for checking color film thickness value to analyze the color film thickness whether acceptable or out of range;

c) if out of range, the closed loop repeated adjustment for color film thickness to determine the new thickness value for color film delivered by production equipment and continuous the next production cycle; and d) if acceptable, the correct color film will deliver onto the substrate for finishing printing to become finished product.

The traditional passive color film thickness controlling method work flow has begun with:

a) color film delivered by production equipment to begin the production;

b) whatever color film thickness on the equipment will deliver onto the substrate for finishing production to become finished product;

c) after the product being made, the passive system of quality control module to conduct the quality inspection process for analyzing whether the finished product is unacceptable or not;

d) for any unacceptable product shall become defect products which has already been produced; and e) based on the defect result to determine the correction value, and then execute the delivering correction color film thickness process for entering the next production cycle.

The invention claimed is:

1. A method for monitoring the production of a fluid film and for delivering the fluid film onto a substrate comprising the steps of: a) activating a dispenser to deliver an amount of raw material through a first path from a storage duct to a metering system and distributing the amount of raw material from the metering system to produce a fluid film; b) allowing the fluid film to pass through the first path to a sampling roller; c) measuring the fluid film on the sampling roller using a data reading device to obtain a film thickness; d) comparing the film thickness with a predetermined reference value and producing a comparison result; e) transmitting the comparison result in real time to a production equipment controlling console; f) adjusting the amount of the raw material by the production equipment controlling console according to the comparison result; g) setting a tolerance deviation, and repeating a)-f) to obtain a fluid film having a film thickness within the tolerance deviation from the predetermined reference value; and h) only subsequent to g), continuously delivering the fluid film having the film thickness within the tolerance deviation from the predetermined reference value obtained in g) through a second path from the metering system onto a substrate.

2. The method of claim 1, wherein the fluid film is a printing ink film.

3. The method of claim 1, wherein a pre-determined neutral black value is treated as a reference value for related primary and subsequent neutral grey component color printing units, and based on the pre-determined neutral black value, the analyzer calculates the reference value for each color printing unit.

4. A method of delivering a fluid film onto a substrate comprising the steps of: a) dispensing an amount of a fluid through a first path from a metering system onto a sampling roller to form a fluid film on the sampling roller; b) measuring a film thickness of the fluid film on the sampling roller; c) comparing the measured film thickness of the fluid film on the sampling roller with a predetermined reference value; d) adjusting the amount of the fluid dispensed from the metering system onto the sampling roller such that the film thickness of the fluid film on the sampling roller is within a tolerance deviation from the predetermined reference value; and e) only subsequent to step d), continuously delivering an amount of the fluid through a second path from the metering system onto a substrate to form a fluid film on the substrate having a film thickness that is also continuously within the tolerance deviation from the predetermined reference value.

5. The method of claim 4, wherein the fluid film is a printing ink film.

6. The method of claim 4, wherein a pre-determined neutral black value is treated as a reference value for related primary and subsequent neutral grey component color printing units, and based on the pre-determined neutral black value, the reference value is calculated for each color printing unit.

7. The method of claim 1, wherein step c) is performed with a single scanning head that is traveled back and forth over the sampling roller.

8. The method of claim 1, wherein step c) is performed with a plurality of scanning heads placed along the sampling roller.

9. The method of claim 4, wherein step b) is performed with a single scanning head that is traveled back and forth over the sampling roller.

10. The method of claim 4, wherein step b) is performed with a plurality of scanning heads placed along the sampling roller.

11. A method of delivering a fluid film onto a substrate comprising the steps of: (1) using a data reading device to pre-examine a film thickness and to determine an even metering volume by: (a) dispensing an amount of a fluid film through a first path onto a sampling roller; (b) measuring a film thickness of the fluid film on the sampling roller; (c) comparing the measured film thickness of the fluid film on the sampling roller with a predetermined reference value; (d) adjusting the amount of the fluid film dispensed onto the sampling roller such that the film thickness of the fluid film on the sampling roller is within a tolerance deviation from the predetermined reference value; and (e) using the adjusted amount of the fluid film dispensed onto the sampling roller to determine an even metering volume; (2) delivering an amount of material to a metering unit that corresponds with the determined even metering volume; and (3) using the metering unit to deliver the amount of material through a second path onto a substrate as a fluid film only when a film thickness of the fluid film on the substrate is also continuously within the tolerance deviation from the predetermined reference value.

* * * * *